US009970444B2

(12) United States Patent
Bourrilhon et al.

(10) Patent No.: US 9,970,444 B2
(45) Date of Patent: May 15, 2018

(54) ADAPTER FOR VACUUM PUMPS AND ASSOCIATED PUMPING DEVICE

(71) Applicant: PFEIFFER VACUUM GMBH, Asslar (DE)

(72) Inventors: Thibaut Bourrilhon, Trevignin (FR); Rainer Mathes, Saint Julien en Genevois (FR); Nicolas Varennes, Brison Saint Innocent (FR)

(73) Assignee: Pfeiffer Vacuum GmbH, Asslar (DE)

( * ) Notice: Subject to any disclaimer, the term of this patent is extended or adjusted under 35 U.S.C. 154(b) by 897 days.

(21) Appl. No.: 14/367,131

(22) PCT Filed: Dec. 20, 2012

(86) PCT No.: PCT/EP2012/076330
§ 371 (c)(1),
(2) Date: Jun. 19, 2014

(87) PCT Pub. No.: WO2013/098178
PCT Pub. Date: Jul. 4, 2013

(65) Prior Publication Data

US 2014/0348634 A1 Nov. 27, 2014

(30) Foreign Application Priority Data

Dec. 26, 2011 (FR) ..... 11 04110

(51) Int. Cl.
*F04D 19/04* (2006.01)
*F04D 25/16* (2006.01)
*F04D 29/60* (2006.01)

(52) U.S. Cl.
CPC ..... *F04D 19/042* (2013.01); *F04D 19/046* (2013.01); *F04D 25/16* (2013.01); *F04D 29/60* (2013.01); *F04D 29/601* (2013.01)

(58) Field of Classification Search
CPC ... F04D 19/04–19/048; F04D 29/601–29/603; F04D 29/644; F04D 25/16; F04D 29/606
(Continued)

(56) References Cited

U.S. PATENT DOCUMENTS 4,732,529 A * 3/1988 Narita ..... F04D 19/046 415/90
5,352,097 A * 10/1994 Itou ..... F04C 23/005 417/203

(Continued)

FOREIGN PATENT DOCUMENTS

EP 1 626 179 A2 2/2006

*Primary Examiner* — Jason Shanske
*Assistant Examiner* — Julian Getachew
(74) *Attorney, Agent, or Firm* — Sughrue Mion, PLLC

(57) ABSTRACT

The invention relates to an adapter for vacuum pumps, characterized in that it comprises an annular inlet flange (15) intended to be coupled to an outlet orifice of a chamber and an outlet coupling (16) comprising at least two cylindrical outlet through-housings (21) and forming an at least partial pump casing for the case (4) of a respective turbomolecular vacuum pump (3), said turbomolecular vacuum pumps (3) being intended to be received in a respective cylindrical outlet housing (21). The invention also relates to a pumping device, characterized in that it comprises an adapter for vacuum pumps (2) as described hereinabove and at least two turbomolecular vacuum pumps (3) housed at least partially in a respective cylindrical outlet housing (21).

18 Claims, 5 Drawing Sheets

Figure 1:
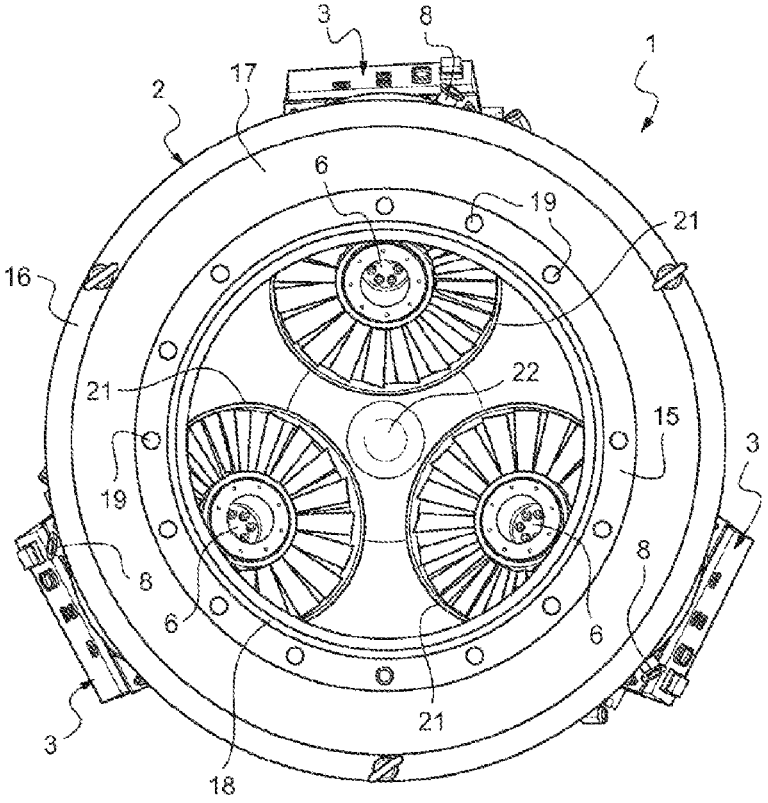

(58) Field of Classification Search
USPC ..... 415/90, 143, 60; 417/423.4
See application file for complete search history.

(56) References Cited

U.S. PATENT DOCUMENTS 6,435,811 B1 * 8/2002 Beyer ..... F04D 17/168
415/116
6,457,954 B1 * 10/2002 Adamietz ..... F04D 17/168
415/90
6,575,713 B2 * 6/2003 Ohtachi ..... F04D 29/668
417/353
7,086,827 B2 * 8/2006 Mokler ..... F04D 19/042
415/102

* cited by examiner

ADAPTER FOR VACUUM PUMPS AND ASSOCIATED PUMPING DEVICE

CROSS REFERENCE TO RELATED APPLICATIONS

This application is a National Stage of International Application No. PCT/EP2012/076330 filed Dec. 20, 2012, claiming priority based on French Patent Application No. 1104110 filed Dec. 26, 2011, the contents of all of which are incorporated herein by reference in their entirety.

The present invention relates to turbomolecular vacuum pumps that are coupled to a chamber for generating a high vacuum.

The generation of the high vacuum inside a chamber requires the use of pumps able to rapidly generate and maintain this high vacuum. Vacuum pumps of the turbomolecular type are generally used, composed of a pump casing accommodating a case and inside which a rotor is driven in rapid rotation, for example rotation at a speed over thirty thousand revolutions per minute.

The pump casing comprises an inlet orifice, coaxial with the rotor, which is coupled to an outlet orifice of the chamber. In general, the pump is secured to the single fixed structure of the chamber, and its support is provided by the single zone surrounding the inlet orifice of the pump and the corresponding outlet orifice of the fixed structure. The pump casing thus comprises a coaxial annular coupling flange surrounding the inlet orifice, which is clamped and screwed to the fixed structure or to an intermediate coupling, which is itself coupled to the fixed structure, in order to secure the vacuum pump to the fixed structure.

Certain processes, such as the processes for manufacturing semiconductors, require the turbomolecular pumps to be capable of absorbing large flows of gas. For example, 450 mm etching processes require the turbomolecular vacuum pumps to be capable of absorbing gas flows in the order of 2000 to 2500 sccm ("standard cubic centimeters per minute") for pressures inside the chamber in the order of 5 to 7 mtorr. In order to absorb such flows, the vacuum pumps must possess pumping capacities greater than approximately 6000 l/s.

Today, few turbomolecular vacuum pumps are able to achieve such pumping capacities. In order to obtain these, one solution involves coupling a plurality of turbomolecular vacuum pumps in parallel to one and the same chamber, in such a way as to add together the respective pumping capacities.

A considerable lack of homogeneity will be noted, however, in the gas velocities inside the chamber, due to the positioning and the conductance of the couplings of the vacuum pumps. The velocities of the gases are also generally inhomogeneous at the level of the inlet orifice of the vacuum pumps, and the multiplication of the couplings of vacuum pumps to the chamber accentuates this inhomogeneity. The resulting disparity that is noted at the velocities of the gases prevailing inside the chamber may be particularly problematical at the level of the substrate of the process chambers, the manufacture of which requires a highly homogeneous distribution of the pressure and the gas flows at the surface.

Another disadvantage is the difficulty encountered in regulating the prevailing pressure inside the chamber. A variable conductance control valve is generally used for regulating the pressure. The control valve is coupled between the outlet orifice of the chamber and the inlet orifice of the turbomolecular vacuum pump. The control of the opening of the valve, to a greater or lesser degree, permits the regulation of the pressure of the chamber to be regulated depending on the flows of gas that are present inside the chamber. It is therefore understandable that, with a plurality of vacuum pumps coupled to the chamber, it is difficult to regulate a plurality of control valves at the same time, given that the control of each individual valve may involve a different variation in pressure inside the chamber, in particular as a result of the positioning of the vacuum pump. This additional difficulty also contributes to the inhomogeneity of the pumping speeds inside the chamber.

One of the objects of the present invention is to propose an adapter for vacuum pumps and a pumping device which go at least part of the way to solving some of the problems of the prior art.

For this reason, the invention has as its object an adapter for vacuum pumps, characterized in that it comprises an annular inlet flange intended to be coupled to an outlet orifice of a chamber and an outlet coupling comprising at least two cylindrical outlet through-housings forming an at least partial pump casing for the case of a respective turbomolecular vacuum pump, said turbomolecular vacuum pumps being intended to be accommodated in a respective cylindrical outlet housing.

According to one or more characterizing features of the adapter, either alone or in combination,

- the outlet coupling comprises a first series of threaded holes, arranged around each external opening of said cylindrical outlet housings, and in that the adapter comprises first additional fixing screws, the first series of threaded holes and said first additional fixing screws being intended to secure a pump casing of a turbomolecular vacuum pump to the adapter,
- the cylindrical outlet housings possess a substantially identical volume and are arranged substantially symmetrically in the outlet coupling,
- the axes of the cylindrical outlet housings are inclined in relation to the axis of the annular inlet flange,
- the section of the adapter joining the annular inlet flange and the outlet coupling is of truncated conical shape,
- the internal diameter of the base of the truncated section is substantially equal to the diameter of the circle, inscribed within which are the projections of the diameters of the inlet orifices of the turbomolecular vacuum pumps,
- the outlet coupling possesses a central dome projecting between said cylindrical housings,
- the adapter comprises a central tubular passageway, coaxial with the annular inlet flange, passing through the center of the outlet coupling, between said cylindrical housings.

The invention also has as its object a pumping device characterized in that it comprises an adapter for vacuum pumps as described previously and at least two turbomolecular vacuum pumps housed at least partially in a respective cylindrical outlet housing.

According to one or a plurality of characterizing features of the pumping device, either alone or in combination,

- the turbomolecular vacuum pumps comprise a respective pump casing comprising a respective coaxial annular flange, inside which a first and a second coaxial series of through-holes are arranged, said first series of through-holes interacting with said first series of threaded holes and the first respective fixing screws of the outlet coupling in order to secure the pump casing of the turbomolecular vacuum pump to the outlet coupling, and said second series of through-holes interacting with a second series of threaded holes arranged in the case and with second respective fixing screws of the outlet coupling in order to secure the case of the turbomolecular vacuum pump to the outlet coupling, the coupling produced by the first fixing screws between the coaxial annular flange and the adapter is stronger than the coupling produced by the second fixing screws between said coaxial annular flange and the case, a respective annular gap is arranged in the base of said cylindrical housings, between said cylindrical housings and the periphery of the first extremity of the case of the turbomolecular vacuum pumps, the turbomolecular vacuum pumps comprise respectively a turbomolecular stage and a molecular stage, and the cylindrical outlet housings are configured so as to house at least the turbomolecular stage of the turbomolecular vacuum pumps, the pumping device comprises at least two first outlet seals intended to be interposed between the respective base of a cylindrical outlet housing and a first extremity of the case of the respective turbomolecular vacuum pump, the pumping device comprises at least two second outlet seals intended to be interposed between the coaxial annular flange of the pump casing and a second extremity of the case of the respective turbomolecular vacuum pump.

The pumping device thus makes it possible to combine the individual pumping capacities of the turbomolecular vacuum pumps in order to obtain a higher resulting pumping capacity.

Unlike the vacuum pumps from the prior art, in which the coupling flange is arranged at the level of the inlet orifice, the coaxial annular flange of the present invention is arranged lower on the turbomolecular vacuum pump, at least one part of the case being housed in the adapter.

The lower positioning of the coaxial annular flange has a number of advantages.

First, the coupling between the turbomolecular vacuum pump and the adapter is relocated to a more remote point than around the inlet orifice of the turbomolecular vacuum pump. It is then possible to bring the various inlet orifices of the respective turbomolecular vacuum pumps closer together and to bring the latter closer to the outlet orifice of the chamber. The thickness of the adapter is limited at the same time, which reduces the pressure loss of the adapter. Furthermore, the closer relative proximity of the turbomolecular vacuum pumps improves the homogeneity of pumping at the level of the annular inlet flange.

In addition, the more remote coupling of the turbomolecular vacuum pump facilitates the provision of an annular gap in the block of the adapter, coaxially to the cylindrical outlet housing, between the cylindrical outlet housings and the periphery of the inlet orifice of the turbomolecular vacuum pumps. This annular gap allows a free space to be provided to permit the case to deform in the event of a crash of the turbomolecular vacuum pump without transmitting excessive loads to the adapter, and consequently to the chamber.

A further advantage is that, by relocating the coaxial annular flange to a lower position, it is possible to utilize fastening screws for the coupling between the coaxial annular flange and the adapter, of which the dimensioning is optimized.

On the one hand, it is possible to utilize fastening screws with a diameter larger than the diameter of the socket head screws of the prior art in order to prevent their shearing in the event of a crash. On the other hand, the fastening screws may be implemented on a diameter larger than that of the prior art, which permits the reduction of the load experienced by the fastening screws during a crash.

The geometry of the adapter thus optimizes the positioning of the turbomolecular vacuum pumps as close as possible to the chamber, in so doing reducing the pressure losses and the dead zones to a maximum. The resulting pumping speed is thus only 8% lower than the theoretical pumping speed. The positioning as close as possible to the chamber likewise permits the physical size of the pumping device to be reduced.

In operation, very high homogeneity of the pumping speeds is thus achieved at the level of the cross section of the annular inlet flange of the adapter, allowing high homogeneity of pumping to be achieved inside the chamber, in particular at the level of the substrate in the case of a chamber of a process chamber.

In addition, a maximum pumping speed may be achieved at the outlet orifice of the chamber, which permits optimal use to be made of the available opening at the outlet from the chamber.

Furthermore, with a single adapter coupling a plurality of pumps, a single cross section is available at the outlet orifice of the chamber joining together all the turbomolecular vacuum pumps, permitting the connection of a single control valve, which facilitates the regulation inside the chamber and reduces the costs of production and maintenance.

Figure 2:
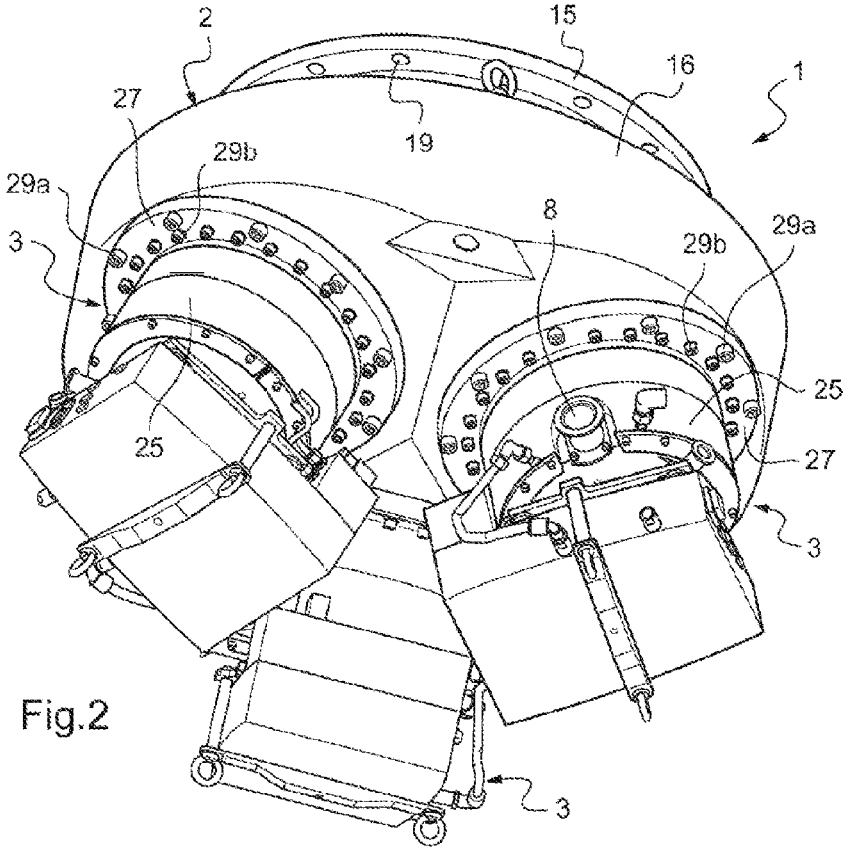
Figure 3:
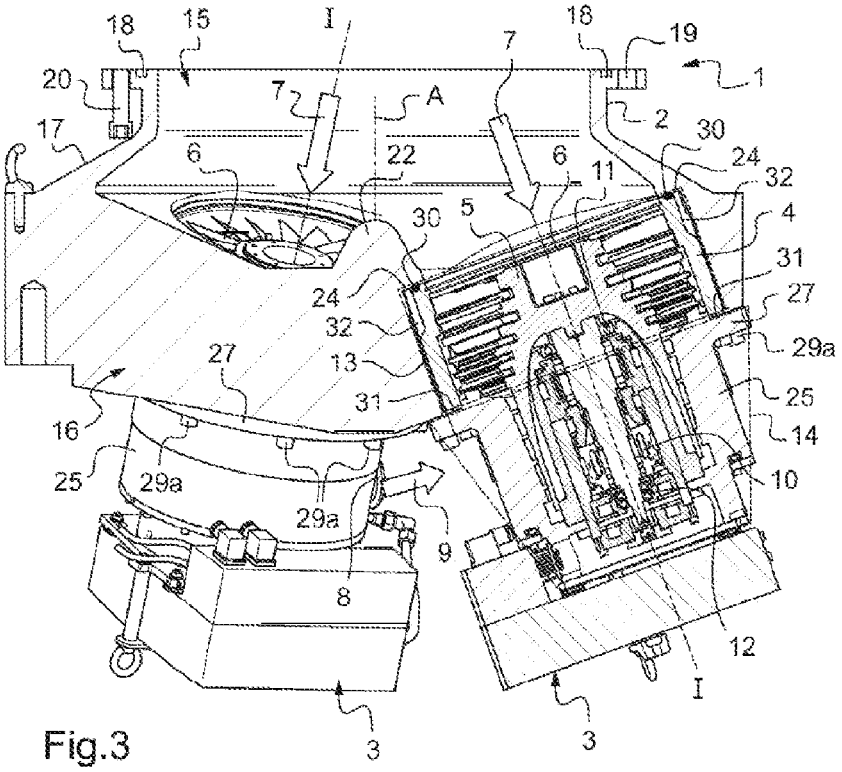
Figure 4:
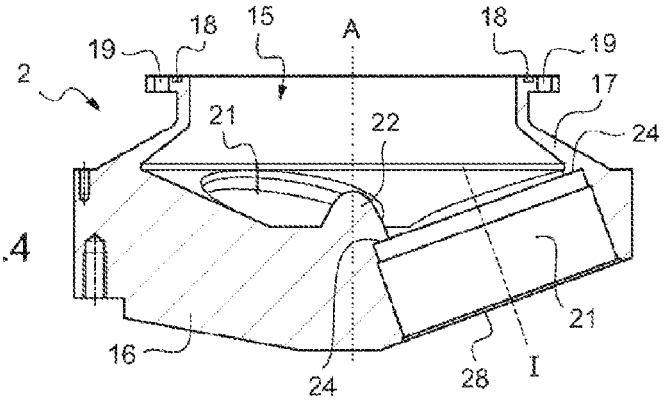
Figure 5:
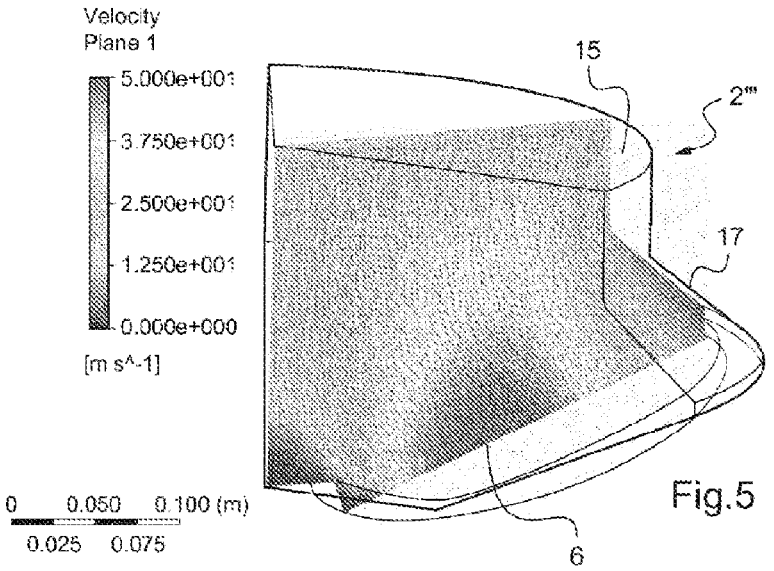
Figure 6A:
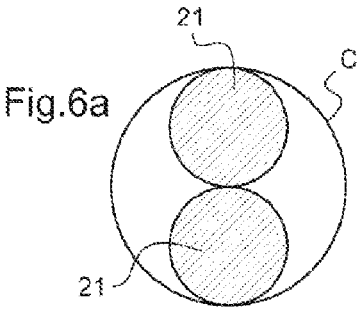
Figure 6B:
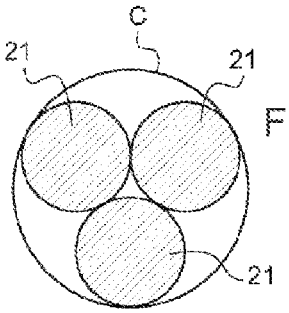
Figure 6C:
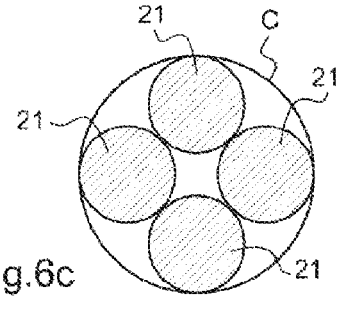
Figure 6D:
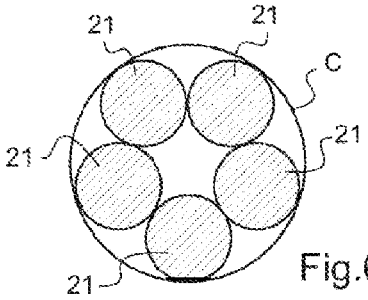
Figure 7:
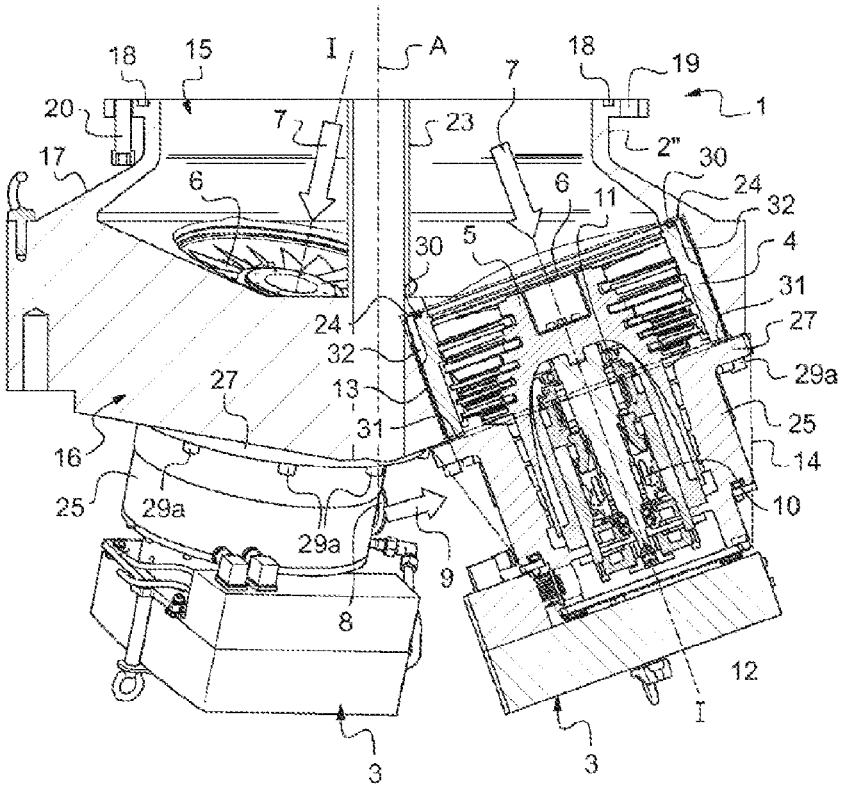

Other characterizing features and advantages of the invention will be appreciated from the following description, which is provided by way of example, although without limitation, having regard for the accompanying drawings, in which:

FIG. 1 represents a view in perspective from above of a pumping device according to a first embodiment, FIG. 2 represents a view in perspective and from below of the pumping device in FIG. 1, FIG. 3 is a view in perspective and in cross section of the pumping device in FIGS. 1 and 2, FIG. 4 is a schematic view in cross section of the adapter of the pumping device in FIGS. 1 to 3, FIG. 5 represents a result of the simulation of the flow of gases in a geometry representing a partially sectioned view of another example of an adapter, and in which are represented the amplitudes and the vectors of the pumped gas velocities in m/s, FIG. 6*a* is a schematic view representing an illustrative arrangement of two turbomolecular vacuum pumps in an outlet coupling, FIG. 6*b* is a schematic view representing an illustrative arrangement of three turbomolecular vacuum pumps in an outlet coupling, FIG. 6*c* is a schematic view representing an illustrative arrangement of four turbomolecular vacuum pumps in an outlet coupling, FIG. 6*d* is a schematic view representing an illustrative arrangement of five turbomolecular vacuum pumps in an outlet coupling, FIG. 7 represents a perspective view of a pumping device according to a second embodiment.

In these figures, the identical elements bear the same reference numbers.

FIGS. 1 to 4 illustrate a first embodiment of a pumping device 1.

The pumping device 1 comprises an adapter for vacuum pumps 2 and at least two turbomolecular vacuum pumps 3, being three in number in the illustrated example.

The turbomolecular vacuum pumps 3 are identical and comprise respectively, in a manner known per se, a fixed part, inside which a rotor 5 rotates at high speed in axial rotation in the axis of rotation I (see the sectional view in FIG. 3).

In the illustrative example, the turbomolecular vacuum pumps 3 comprise respectively a turbomolecular stage 13 and a molecular stage 14.

At the level of the turbomolecular stage 13, the fixed part comprises a case 4 comprising an inlet orifice 6 coaxial with the axis of rotation I at a first extremity, and through which the pumped gases 7 penetrate.

According to one illustrative embodiment, the rotor 5 consists of an upstream section (in the direction of flow of the gases) of a blade rotor of the turbo type at the level of the turbomolecular stage 13 capable of rotating inside the case 4, and a downstream section (in the direction of flow of the gases) of a rotor in the form of a skirt of the HOLWECK type in the molecular stage 14.

The rotor 5 is driven rotationally in the fixed part by an internal motor 10, and is guided laterally by magnetic or mechanical bearings 11 and 12. The pumped gases 7 are then evacuated via a discharge orifice 8 from the vacuum pump (arrow 9).

The adapter 2 is intended to couple and secure the three turbomolecular vacuum pumps 3 to the wall of a chamber inside which a controlled vacuum may be created, such as a chamber for processes for manufacturing semiconductors (not illustrated).

For this purpose, the adapter 2 comprises an annular inlet flange 15 and an outlet coupling 16 that are connected by a section 17 of the adapter 2, for example in the form of a truncated cone. The truncated conical section 17 allows the diameter of the outlet coupling 16 to be enlarged in relation to the diameter of the annular inlet flange 15 in order for it to accommodate a plurality of turbomolecular vacuum pumps 3 having a shape limiting the dead zones over a relatively short distance (the truncated conical section possesses a thickness in the order of 65 mm in this example with an angle in the order of 45°).

The annular inlet flange 15 is intended to be coupled to the wall of the chamber, around an outlet orifice of the chamber. The annular inlet flange 15 is coaxial with the outlet orifice of the chamber (axis A in FIG. 3) and possesses a tubular shape, of which the internal diameter corresponds to the diameter of the outlet orifice of the chamber (450 mm in the example). The pumping device 1 comprises in addition an inlet seal situated in a throat 18 arranged in the annular inlet flange 15, the inlet seal being intended to be interposed between the annular inlet flange 15 and the wall of the chamber, around the outlet orifice of the chamber in order to seal the coupling of the chamber to the adapter 2. According to a variant embodiment (not illustrated), the pumping device comprises an inlet seal carrier ring, around which the annular inlet flange 15 is accommodated. The inlet seal carrier ring is capable of interacting with the internal edge of the annular inlet flange and the edge of the outlet orifice between which it is interposed, in order to support and center the annular inlet flange 15.

In accordance with the applicable standards, threaded holes are provided in the wall of the chamber, distributed around the outlet orifice, whereas through-holes 19 are provided on the annular inlet flange 15 of the adapter 2, and fastening screws 20, such as socket head screws, are adapted in such a way that their shanks pass through the through-holes 19 and are screwed into the associated threaded holes in order to secure the adapter 2 to the chamber by clamping the annular inlet flange 15 against the wall of the chamber.

The outlet coupling 16 comprises at least two cylindrical outlet housings 21 (FIG. 4), being three in number in this example: one for each turbomolecular vacuum pump 3.

The cylindrical housings 21 are through-housings, as such forming a plurality of bypass outlets in the outlet coupling 16 for the pumped gases. These cylindrical outlet housings 21 form an at least partial pump casing for the case 4 of the respective turbomolecular vacuum pump 3. They are coaxial with the axis of rotation I of the turbomolecular vacuum pumps 3.

The cylindrical housings 21 are bores, for example, arranged in a monobloc adapter 2 made of an aluminum material, for example.

As can be appreciated from the embodiment in FIG. 3, the through cylindrical housings 21 possess a thickness corresponding to the total length of the case 4 of the turbomolecular stage 13 (in the order of 138 mm in this example), in order to house the turbomolecular stage 13 of the turbomolecular vacuum pumps 3.

The cylindrical housings 21 possess a substantially identical volume in order to accommodate three identical turbomolecular vacuum pumps. Given that the through cylindrical outlet housings 21 are arranged in the form of a bypass in the outlet coupling 16, the individual pumping capacities of three turbomolecular vacuum pumps 3 are combined in order to obtain a resulting greater pumping capacity.

Furthermore, the cylindrical housings 21 are arranged substantially symmetrically in the outlet coupling 16.

The internal diameter of the base of the truncated conical section 17 is substantially equal to the diameter of the circle inside which are inscribed the projections of the diameters of the inlet orifices 6 of the turbomolecular vacuum pumps 3.

Although FIGS. 1 to 4 illustrate a pumping device 1 comprising three turbomolecular vacuum pump 3, other embodiments integrating two, three, four or five turbomolecular vacuum pumps 3 are possible.

Illustrated in a schematic manner in FIGS. 6*a*, 6*b*, 6*c* and 6*d* are examples of symmetrical arrangements of the outlet housings 21, for which the outlet coupling 16 possesses a generally cylindrical shape, coaxial with the annular inlet flange 15, and for which the axes of the cylindrical outlet housings 21 are parallel, the inlet orifices 6 of the turbomolecular vacuum pumps 3 being substantially in the same plane, parallel to the plane containing the inlet orifice of the chamber. In these examples, the internal diameter of the base of the truncated conical section 17 is substantially equal to the diameter of the circle C, inside which are inscribed the projections of the diameters of the inlet orifices 6 of the turbomolecular vacuum pumps 3.

In order to reduce the physical size, and as depicted in the first illustrative embodiment in FIGS. 1 to 4, the axes of the cylindrical outlet housings 19 are inclined in relation to the axis of the annular inlet flange 15.

In cases in which the adapter 2 comprises three or more cylindrical outlet housings 21, provision can be made for the outlet coupling 16 to comprise a central dome 22, projecting between said cylindrical housings 21. In fact, the inventors have established that, by arranging a central dome 22 in the outlet coupling 16, a central dead zone is suppressed in which the pumping speeds had slowed down and were able to bring about either the formation of a local deposit or reactions between different gases which could not be correctly evacuated.

The central dome 22 possesses, for example, the general shape of a bell, of which the base diameter is tangent to the diameters of the inlet orifices 6 of the turbomolecular vacuum pumps 3. The arrangement of a central dome 22 suppresses the central dead zone by guiding the gases towards one or other of the turbomolecular vacuum pumps 3.

According to a variant embodiment depicted in FIG. 7, in place of the central dome, the adapter 2' comprises a central tubular passage 23, coaxial with the annular inlet flange 15 and passing through the adapter 2' from one end to the other: at the center of the outlet coupling 16' and between said cylindrical housings 21.

The central tubular passage 23, like the central dome 22, makes it possible to suppress a central dead zone in which the pumping speeds have slowed down. The diameter of the central tubular passage 23 is tangent to the diameters of the inlet orifices 6 of the turbomolecular vacuum pumps 3. In addition to suppressing a dead zone, and once it has been sealed on both sides, this central tubular passage 23 is particularly useful in the case of a chamber of a process chamber in order to permit the passage of the services (means of heating/cooling, electrodes, nitrogen . . . ) which are utilized for the operation of the substrate carrier situated inside the chamber, for example substantially in vertical alignment with the outlet orifice of the chamber.

Moreover, each cylindrical outlet housing 21 possesses an annular internal stop 24, in the base of the housing 21, against which the first extremity of the case 4 of the turbomolecular vacuum pump 3 (inlet side) comes into abutment.

The turbomolecular vacuum pumps 3 further comprise a respective pump casing 25 housing the molecular stage 14.

The pump casings 25 comprise an annular flange 27 that is coaxial with the axis of rotation I of the rotor 5, in which flange a first and a second coaxial series of through-holes are arranged. The second series of through-holes is internal in relation to the first series. The coaxial annular flange 27 is arranged substantially on a level with the interface between the turbomolecular stage 13 and the molecular stage 14, in order to enable it to connect to the cylindrical outlet housing 21 of the adapter 2.

Unlike the vacuum pumps of the prior art, in which the coupling flange is arranged at the level of the inlet orifice, the coaxial annular flange 27 is arranged lower on the turbomolecular vacuum pump 3, after the molecular stage, at the level of the pump casing 25, the turbomolecular stage 13 being housed in the adapter 2.

The outlet coupling 16 comprises a first series of threaded holes (three first series in the example), arranged respectively around external openings 28 of the cylindrical outlet housings 21.

The adapter 2 likewise comprises first and second complementary fixing screws 29*a*, 29*b*, such as socket head screws.

The first fastening screws 29*a*, are adapted in such a way that their shanks pass through the first series of through-holes in the coaxial annular flange 27 of the turbomolecular vacuum pumps 3 and are screwed into the first series of associated threaded holes in the outlet coupling 16 in order to secure the pump casing 25 of the turbomolecular vacuum pumps 3 to the adapter 2 by clamping the coaxial annular flanges 27 against the wall of the outlet coupling 16.

The second fastening screws 29*b* are adapted in such a way that their shanks pass through the second series of through-holes in the coaxial annular flange 27 of the turbomolecular vacuum pumps 3 and are screwed into the second series of associated threaded holes arranged at the second extremity of the case 4 at the level of the respective external opening 28 in the cylindrical housings 21 in order to secure the pump casing 25 to the case 4.

It will also be appreciated that the first fastening screws 29*a* are dimensioned so as to withstand a crash of the turbomolecular vacuum pump 3.

In order to do this, the first fastening screws 29*a* possess a diameter larger than the diameter of the socket head screws of the prior art in order to avoid their shearing in the event of a crash.

Furthermore, the first fastening screws 29*a* are implemented on a diameter larger than that of the prior art, such as 335 mm in place of 310 mm, that is to say that the diameter of the coaxial annular flange 27 possesses a diameter larger than that of the standardized coupling flange of the prior art, which permits the reduction of the load experienced by these fastening screws 29*a* during a crash.

The first fastening screws 29*a* are thus dimensioned in such a way that the coupling between the coaxial annular flange 27 and the adapter 2 is stronger than the coupling produced by the second fastening screws 29*b* between said coaxial annular flange 27 and the case 4.

The pumping device 1 further comprises at least two first outlet seals 30 (being three in number in the illustration) and at least two second outlet seals 31 (being three in number in the illustration).

Each first outlet seal 30 is interposed between the annular internal stop 24 for the cylindrical outlet housings 21 and the first extremity of the case 4 of the turbomolecular vacuum pumps 3 in a throat arranged in the case 4 (or the cylindrical outlet housing 21) for the purpose of sealing the coupling of the turbomolecular vacuum pumps 3 to the adapter 2 around the inlet orifice 6 of the pumps 3. According to one variant embodiment, the pumping device comprises an outlet seal carrier ring, around which the annular outlet seal 30 is accommodated. The outlet seal carrier ring is able to interact with the first extremity of the case 4 and the internal edge of the cylindrical outlet housing 21, between which it is interposed in order to support and center the annular outlet seal 30.

The second outlet seals 31 are interposed between the coaxial annular flange 27 of the pump casing 25 and the second extremity of the case 4 at the level of the respective exterior opening 28 of the cylindrical outlet housings 21.

An annular gap 32, which is coaxial with the cylindrical outlet housing 21, is arranged between the annular internal stop 24 of the cylindrical housings 21 and the periphery of the first extremity of the case 4 of the turbomolecular vacuum pumps 3. The annular gap possesses, for example, a radial thickness in the range between 3 and 10 mm over an axial length in the range between 25 and 40 mm.

The first outlet seals 30 interposed between the cylindrical housings 21 and the first extremities of the cases 4 make it possible to prevent the entry of the pumped gases into the annular gap 32 and accordingly the formation of deposits inside this space.

In the event of the accidental imbalance of the rotor 5 when it is running at full speed, the rotor can strike the cylindrical outlet housing 21 violently, thereby imposing on it a transverse or radial displacement force, and it can rub heavily against the wall of the cylindrical housing 21, thereby imposing on it a coaxial rotational torque. As a result of the considerable energy accumulated in the rotor 5 as it rotates rapidly, the mechanical loads that are applied by the rotor 5 to the case 4 are very high. The annular gap 32 allows a free space to be provided for the case 4, which is then likewise able to rotate as a result of the shearing of the second fastening screws 29*b*, which are less strong than the first fastening screws 29*a*, and is able to deform in the cylindrical outlet housing 21. The second outlet seals 31 interposed between the coaxial annular flanges 27 of the pump casings 25 and the second extremity of the case 4 permit any debris resulting from this crash to be contained in the turbomolecular vacuum pumps 3. The transmission of the loads to the chamber is thus limited in the event of a crash of the turbomolecular vacuum pump 3.

Once they have been installed in the cylindrical outlet housings 21, the turbomolecular vacuum pumps 3 are securely attached to the adapter 2, partially recessed, and are coupled in a sealed manner to the chamber. The lower positioning of the coaxial annular flange 27 allows the various inlet orifices 6 of the respective turbomolecular vacuum pumps 3 to be brought closer to one another, and allows the latter to be brought closer to the outlet orifice of the chamber. The limitation of the thickness of the adapter 2 allows the loss of pressure due to the adapter 2 to be reduced. Bringing the inlet orifices 6 of the turbomolecular vacuum pumps 3 closer to one another improves the homogeneity of the pumping at the level of the annular inlet flange.

FIG. 5 depicts a simulation of the flow of gases in a geometry representing an adapter like that in the preceding figures, but without a central dome.

During pumping, as can be appreciated from the simulation in FIG. 5, and even though the pumping speeds are substantially inhomogeneous at the level of the inlet orifices 6 of the turbomolecular vacuum pumps 3, the pumping speeds fluctuate by up to two times, and very good homogeneity of the pumping speeds is achieved at the level of the cross section of the annular inlet flange 15 of the adapter 2''' (in the order of 25 m/s everywhere). Since the adapter depicted here does not possess a central dome, a dead zone (where the gas velocity is zero) can be visualized between the inlet orifices 6.

Good pumping homogeneity can thus be achieved inside the chamber, in particular at the level of the substrate in the case of a chamber of a process chamber. In addition, thanks to the geometry of the adapter 2, a maximum homogeneous pumping speed can be achieved at the outlet orifice, which permits full use to be made of the available opening at the outlet of the chamber.

The optimized geometry of the adapter 2 thus positions the turbomolecular vacuum pumps 3 as close as possible to the chamber, with an optimized conductance, in so doing reducing the pressure losses and the dead zones to a maximum. The resulting pumping speed is thus only 8% lower than the theoretical pumping speed. The positioning as close as possible to the chamber likewise permits the physical size of the pumping device 1 to be reduced.

Furthermore, with a single adapter 2 coupling a plurality of pumps 3, a single cross section is available at the outlet orifice of the chamber joining together all the turbomolecular vacuum pumps 3, thereby permitting the connection of a single control valve, which facilitates regulation inside the chamber and reduces the costs of production and maintenance.

The invention claimed is:

1. An adapter for vacuum pumps, characterized in that it comprises an annular inlet flange configured to be coupled to an outlet orifice of a chamber, and an outlet coupling comprising at least two cylindrical outlet through-housings each forming an at least partial pump casing for surrounding a case of a respective one of at least two turbomolecular vacuum pumps, said case surrounding an inlet end of said respective turbomolecular vacuum pump, and said at least two turbomolecular vacuum pumps being configured to be accommodated in a respective cylindrical outlet through-housing, wherein each of the at least two cylindrical outlet through-housings has a central axis inclined in relation to a central axis of the annular inlet flange.

2. The adapter as claimed in claim 1, characterized in that the outlet coupling comprises a first series of threaded holes, arranged around an external opening of each of said at least two cylindrical outlet through-housings, and in that the adapter comprises first fixing screws, said first series of threaded holes and said first fixing screws being configured to secure a pump casing member of a turbomolecular vacuum pump to one of said at least partial pump casings of the adapter.

3. The adapter as claimed in claim 1, characterized in that the at least two cylindrical outlet through-housings possess an approximately identical volume and are arranged approximately symmetrically in the outlet coupling.

4. The adapter as claimed in claim 1, characterized in that the adapter has a section joining the annular inlet flange and the outlet coupling, and said section is of truncated conical shape.

5. The adapter as claimed in claim 4, characterized in that an internal diameter of a base of the section is approximately equal to a diameter of a circle within which are inscribed projections of diameters of inlet orifices of the at least two turbomolecular vacuum pumps.

6. The adapter as claimed in claim 1, characterized in that the outlet coupling possesses a central dome projecting between said at least two cylindrical outlet through-housings.

7. The adapter as claimed in claim 1, characterized in that it comprises a central tubular passageway, coaxial with the annular inlet flange, passing through a center of the outlet coupling, between said at least two cylindrical outlet through-housings.

8. A pumping device, characterized in that it comprises the adapter for vacuum pumps of claim 1 and said at least two turbomolecular vacuum pumps each housed at least partially in a respective one of said at least two cylindrical outlet through-housings.

9. The pumping device as claimed in claim 8, characterized in that an annular gap is arranged in a base of each of the at least two cylindrical outlet through-housings, between said at least two cylindrical outlet through-housings and a periphery of a first extremity of the case of each of the at least two turbomolecular vacuum pumps.

10. The pumping device as claimed in claim 8, characterized in that the at least two turbomolecular vacuum pumps each comprise a turbomolecular stage and a molecular stage, and in that the at least two cylindrical outlet through-housings are configured so as to house at least the turbomolecular stages of the at least two turbomolecular vacuum pumps.

11. The pumping device as claimed in 8, wherein each of said at least two cylindrical outlet through-housings forms a bypass outlet for pump gases in the outlet coupling.

12. The pumping device as claimed in 8, wherein the central axis of each of said at least two cylindrical outlet through-housings is coaxial with an axis of rotation of its respective turbomolecular pump.

13. The pumping device as claimed in claim 8, characterized in that it comprises at least two first outlet seals each intended to be interposed between a base of a respective cylindrical outlet through-housing and a first extremity of the case of a respective turbomolecular vacuum pump.

14. The pumping device as claimed in claim 13, characterized in that it comprises at least two second outlet seals each configured to be interposed between a coaxial annular flange of a pump casing and a second extremity of the case of a respective turbomolecular vacuum pump.

15. The adapter as claimed in claim 1, wherein each of said at least two cylindrical outlet through-housings forms a bypass outlet for pump gases in the outlet coupling.

16. The adapter as claimed in claim 1, wherein the central axis of each of said cylindrical outlet through-housings is coaxial with an axis of rotation of its respective turbomolecular pump.

17. A pumping device, characterized in that it comprises:

an adapter for vacuum pumps, comprising an annular inlet flange configured to be coupled to an outlet orifice of a chamber, and an outlet coupling comprising at least two cylindrical outlet through-housings each forming an at least partial pump casing for surrounding a case of a respective one of at least two turbomolecular vacuum pumps, said case surrounding an inlet end of said respective turbomolecular vacuum pump, and said at least two turbomolecular vacuum pumps being configured to be accommodated in a respective cylindrical outlet through-housing, characterized in that the outlet coupling comprises a first series of threaded holes, arranged around an external opening of each of said at least two cylindrical outlet through-housings, and in that the adapter comprises first fixing screws, said first series of threaded holes and said first fixing screws being configured to secure a pump casing member of a turbomolecular vacuum pump to one of said at least partial pump casings of the adapter, and said at least two turbomolecular vacuum pumps housed at least partially in a respective cylindrical outlet through-housing, characterized in that the at least two turbomolecular vacuum pumps comprise a respective pump casing member comprising a respective coaxial annular flange, inside which a first and a second coaxial series of through-holes are arranged, said first series of through-holes interacting with said first series of threaded holes and the respective first fixing screws of the outlet coupling in order to secure the pump casing member of the turbomolecular vacuum pump to the outlet coupling and said second series of through-holes interacting with a second series of threaded holes arranged in the case and with respective second fixing screws of the outlet coupling in order to secure the case of the turbomolecular vacuum pump to the outlet coupling.

18. The pumping device as claimed in claim 17, characterized in that the coupling produced by the first fixing screws between the coaxial annular flange and the adapter is stronger than the coupling produced by the second fixing screws between said coaxial annular flange and the case.

* * * * *